US006673308B2

(12) United States Patent
Hino et al.

(10) Patent No.: US 6,673,308 B2
(45) Date of Patent: Jan. 6, 2004

(54) NICKEL-BASE SINGLE-CRYSTAL SUPERALLOYS, METHOD OF MANUFACTURING SAME AND GAS TURBINE HIGH TEMPERATURE PARTS MADE THEREOF

(75) Inventors: Takehisa Hino, Sagamihara (JP); Yutaka Koizumi, Ryugasaki (JP); Toshiharu Kobayashi, Ryugasaki (JP); Shizuo Nakazawa, Suginami-Ku (JP); Hiroshi Harada, Tsukuba (JP); Yutaka Ishiwata, Zushi (JP); Yomei Yoshioka, Yokohama (JP)

(73) Assignees: Kabushiki Kaisha Toshiba, Tokyo (JP); Independent Administrative Institution National Institute for Material Science, Tsukuba (JP)

( * ) Notice: Subject to any disclaimer, the term of this patent is extended or adjusted under 35 U.S.C. 154(b) by 0 days.

(21) Appl. No.: 09/941,699

(22) Filed: Aug. 30, 2001

(65) Prior Publication Data

US 2002/0062886 A1 May 30, 2002

(30) Foreign Application Priority Data

Aug. 30, 2000 (JP) ..... P2000-261137

(51) Int. Cl.[7] ..... C22C 19/05
(52) U.S. Cl. ..... 420/448; 420/443; 148/428
(58) Field of Search ..... 420/448, 443; 148/428

(56) References Cited

U.S. PATENT DOCUMENTS

| | | | | |
|---|---|---|---|---|
| 4,719,080 A | | 1/1988 | Duhl et al. | |
| 5,077,141 A | * | 12/1991 | Naik et al. | 428/680 |
| 5,366,695 A | * | 11/1994 | Erickson | 420/448 |
| 5,549,765 A | * | 8/1996 | Mihalisin et al. | 148/428 |
| 5,740,668 A | * | 4/1998 | Fujiwara et al. | 60/39.75 |
| 5,916,382 A | * | 6/1999 | Sato et al. | 148/404 |
| 6,051,083 A | * | 4/2000 | Tamaki et al. | 148/410 |
| 6,159,314 A | | 12/2000 | Koizumi et al. | |
| 6,419,763 B1 | * | 7/2002 | Konter et al. | 148/404 |
| 6,444,057 B1 | * | 9/2002 | Darolia et al. | 148/428 |

FOREIGN PATENT DOCUMENTS

| | | |
|---|---|---|
| EP | 0 913 506 | 5/1999 |
| EP | 0 962 542 | 12/1999 |
| FR | 2 780 983 | 1/2000 |
| GB | 2 105 748 | 3/1983 |

OTHER PUBLICATIONS

K. Bouhanek, et al., Mater. Sci. Forum., pp. 33–40, XP–002194007, "High–Temperature Oxidation of Single–Crystal Ni–Base Superalloys", 1997.

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A nickel-base single-crystal superalloy, essentially consists of, in percentages by weight, 4.0% to 11.0% of cobalt, 3.5% to less than 5.0% of chromium, 0.5% to 3.0% of molybdenum, 7.0% to 10.0% of tungsten, 4.5% to 6.0% of aluminum, 0.1% to 2.0% of titanium, 5.0% to 8.0% of tantalum, 1.0% to 3.0% of rhenium, 0.01% to 0.5% of hafnium, 0.01% to 0.1% of silicon, and a balance being nickel and inevitable impurity, a total amount of rhenium and chromium being not less than 4.0% and a total amount of rhenium, molybdenum, tungsten and chromium being not more than 18.0%.

21 Claims, 6 Drawing Sheets

NICKEL-BASE SINGLE-CRYSTAL SUPERALLOYS, METHOD OF MANUFACTURING SAME AND GAS TURBINE HIGH TEMPERATURE PARTS MADE THEREOF

BACKGROUND OF THE INVENTION

The present invention relates to a nickel-base single-crystal superalloy applied to high temperature parts (heat resisting parts) of an industrial gas turbine, such as turbine blades and vanes, a method of manufacturing such superalloy, and gas turbine high temperature parts made of such a superalloy or manufactured in accordance with such method.

With a trend towards high efficiency of a gas turbine, combustion temperature therein rises, so that material for turbine rotor and stator blades has changed from a type of conventional cast alloy to a type of directionally solidified alloy, in which a crystal grain boundary along a stress axial direction is removed to improve creep strength at high temperatures and further to a type of single-crystal alloy, in which grain boundary strengthening elements, the presence of which is a cause for decreasing heat treatment window, are excluded by allowing the crystal grain boundary itself to disappear, so that an optimum heat treatment is applied to increase a volume fraction of gamma prime phase, whereby the creep strength at the high temperatures are further improved.

Development of the single-crystal alloy has switched from the first generation single-crystal superalloy to the second and third generation single-crystal superalloys, aiming at a still further improvement in the creep strength.

The first generation single-crystal superalloy contains no rhenium. Examples of such an alloy include "CMSX-2" disclosed in Japanese Laid-Open Patent Publication No. SHO 59-19032, "Rene'N4" disclosed in U.S. Pat. No. 5,399,313, "PWA-1480" disclosed in Japanese Laid-Open Patent Publication No. SHO 53-146223, and the like.

Stress rupture temperature of the second generation single-crystal superalloys contain about 3% of rhenium is increased by about 30° C. in comparison with that of the first generation single-crystal superalloys. Examples of such an alloy include "CMSX-4" disclosed in U.S. Pat. No. 4,643,782, "PWA-1484" disclosed in U.S. Pat. No. 4,719,080, "Rene'N5" disclosed in Japanese Patent Laid-Open Publication No. HEI 5-59474, and the like.

The third generation single-crystal superalloy contains about 5% to 6% of rhenium. Examples of such an alloy include "CMSX-10" disclosed in Japanese Patent Laid-Open Publication No. HEI 7-138683, and the like.

These single-crystal alloys have been remarkably developed mainly in a field of aircraft jet engines and small gas turbines. It has been intended to convert such technology into a field of large-sized gas turbines for industrial use because of achieving high temperatures directing to improvements in combustion efficiency.

The large-sized gas turbine for industrial use takes longer time for design life as compared with aircraft jet engine or small gas turbine. Accordingly, blade materials require characteristic properties to inhibit formation of TCP (Topologically Close-Packed phase), which serves as a deteriorating phase when used, i.e., a good structural stability.

In the third generation single-crystal superalloy, addition of rhenium in an amount of 5% to 6% makes it possible to increase creep strength in comparison with the second generation single-crystal superalloy. However, the TCP phase, which may serve as a initiation site of creep and low-cycle fatigue failure, tends to occur after using a long period of service time. In the light of such problems, it is therefore hard to apply the third generation single-crystal superalloy to material for the large-sized gas turbine. In view of increase in firing temperature, there has however been demanded material having further higher creep strength.

SUMMARY OF THE INVENTION

An object of the present invention is to substantially eliminate defects or drawbacks encountered in the prior art mentioned above and to provide a nickel-base single-crystal superalloy improved in creep strength and microstructural stability under a high temperature condition, a method of manufacturing such a superalloy and gas turbine high temperature (heat resisting) parts made thereof.

After studies of components of elements contained in a superalloy and amounts thereof, the inventors of the subject application had a finding that there can be obtained a single-crystal alloy, which has at least the same creep strength as that of a single-crystal alloy of the second generation at a temperature of up to 900° C. and under a stress of at least 200 MPa, and on the one hand, the creep strength larger than that of the above-mentioned single-crystal alloy of the second generation at a temperature of at least 900° C. and under a stress of up to 200 MPa, in addition to an excellent structural stability, a method for manufacturing such a specific superalloy and a high temperature (hest resisting) gas turbine part made thereof.

That is, the above and other objects can be achieved according to the present invention by providing, in one aspect, a nickel-base single-crystal superalloy, essentially consisting of, in percentages by weight, 4.0% to 11.0% of cobalt, 3.5% to less than 5.0% of chromium, 0.5% to 3.0% of molybdenum, 7.0% to 10.0% of tungsten, 4.5% to 6.0% of aluminum, 0.1% to 2.0% of titanium, 5.0% to 8.0% of tantalum, 1.0% to 3.0% of rhenium, 0.01% to 0.5% of hafnium, 0.01% to 0.1% of silicon, and a balance being nickel and inevitable impurity, a total amount of rhenium and chromium being not less than 4.0% and a total amount of rhenium, molybdenum, tungsten and chromium being not more than 18.0%.

Further, it is to be noted that an expression such as "4.0% to 11.0% of cobalt" in the present specification equivalently means "cobalt of not less than 4.0% and not more than 11.0%", and this is to be applied throughout the present specification.

In another aspect, there is provided a nickel-base single-crystal superalloy, essentially consisting of, in percentages by weight, 5.0% to 10.0% of cobalt, 4.0% to less than 5.0% of chromium, 1.0% to 2.5% of molybdenum, 8.0% to 9.0% of tungsten, 5.0% to 5.5% of aluminum, 0.1% to 1.0% of titanium, 6.0% to 7.0% of tantalum, 2.0% to 3.0% of rhenium, 0.01% to 0.5% of hafnium, 0.01% to 0.1% of silicon, and a balance being nickel and inevitable impurity, a total amount of rhenium and chromium being not less than 4.0% and a total amount of rhenium, molybdenum, tungsten and chromium being not more than 18.0%.

In a further aspect, there is also provided a nickel-base single-crystal superalloy, essentially consisting of, in percentages by weight, 5.0% to 10.0% of cobalt, 4.0% to less than 5.0% of chromium, 1.0% to 2.5% of molybdenum, 8.0% to 9.0% of tungsten, 5.0% to 5.5% of aluminum, 0.8% to 1.5% of titanium, 5.0% to less than 6.0% of tantalum, 2.0% to 3.0% of rhenium, 0.01% to 0.5% of hafnium, 0.01% to 0.1% of silicon, and a balance being nickel and inevitable impurity, a total amount of rhenium and chromium being not less than 4.0% and a total amount of rhenium, molybdenum, tungsten and chromium being not more than 18.0%.

In a still further aspect, there is also provided a nickel-base single-crystal superalloy, essentially consisting of, in percentages by weight, all of elements listed in a following group A, at least one of elements selected from a following group B and a balance being nickel and inevitable impurity:

A: 4.0% to 11.0% of cobalt, 3.5% to less than 5.0% of chromium, 0.5% to 3.0% of molybdenum, 7.0% to 10.0% of tungsten, 4.5% to 6.0% of aluminum, 0.1% to 2.0% of titanium, 5.0% to 8.0% of tantalum, 1.0% to 3.0% of rhenium, 0.01% to 0.5% of hafnium, and 0.01% to 0.1% silicon, B: less than 2% of niobium, less than 1% of vanadium, less than 2% of ruthenium, less than 1% of carbon, less than 0.05% of boron, less than 0.1% of zirconium, less than 0.1% of yttrium, less than 0.1 of lanthanum, and less than 0.1% of cerium.

In a still further aspect, there is also provided a nickel-base single-crystal superalloy, essentially consisting of, in percentages by weight, all of elements listed in a following group C, at least one of elements selected from a following group D and a balance being nickel and inevitable impurity:

C: 5.0% to 10.0% of cobalt, 4.0% to less than 5.0% of chromium, 1.0% to 2.5% of molybdenum, 8.0% to 9.0% of tungsten, 5.0% to 5.5% of aluminum, 0.1% to 1.0% of titanium, 6.0% to 7.0% of tantalum, 2.0% to 3.0% of rhenium, 0.01% to 0.2% of hafnium, and 0.01% to 0.1% silicon, D: less than 2% of niobium, less than 1% of vanadium, less than 2% of ruthenium, less than 1% of carbon, less than 0.05% of boron, less than 0.1% of zirconium, less than 0.1% of yttrium, less than 0.1% of lanthanum, and less than 0.1% of cerium.

Hereunder, description will be given to advantageous effects of each element in the compositions of alloy as well as reasons for restricting the compositions.

Cobalt (Co) is an element which replaces nickel (Ni) in gamma-phase to strengthen the matrix in solid solution. The reason for limiting the cobalt content within the range of from 4.0% to 11.0% in percentages by weight in the present invention is in that with a cobalt content of less than 4%, a sufficient effect of strengthening the matrix in solid solution cannot be obtained, on the one hand, and with a cobalt content of over 11.0%, an amount of gamma prime phase decreases, degrading conversely the creep strength. A more preferable cobalt content is within the range of from 5.0% to 10.0%.

Chromium (Cr) is an element for improving high-temperature corrosion resistance. The reason for limiting the chromium content to at least (i.e., not less than) 3.5% in the present invention is in that, with a chromium content of under 3.5%, a desirable high-temperature corrosion resistance cannot be ensured. In the present invention, at least 0.5% molybdenum, at least 7.0% tungsten and at least 1.0% rhenium are contained as described later in order to improve the high-temperature strength. Chromium, molybdenum, tungsten and rhenium mainly enter into the gamma-phase in solid solution. When the amounts of them in the solid solution exceeds the prescribed limitations, the TCP such as rhenium-chromium-tungsten, rhenium-tungsten and the like precipitates in the nickel matrix. The TCP phase degrades a creep property and a low-cycle fatigue property. The higher limit of the chromium content by which the TCP phase does not precipitates, depends on an amount of gamma prime phase precipitated, which is a compound of aluminum, titanium, tantalum and nickel, as well as amounts of elements entering into the nickel matrix for solid solute strengthener. In accordance with the alloy composition of the present invention, the above-mentioned higher limit of the chromium content is under 5% so that the volume fraction (i.e., area ratio) of the TCP precipitates has no influence on the creep property and the low-cycle fatigue property as long as the total amount of rhenium, molybdenum, tungsten and chromium is up to (i.e., not more than) 18.0%.

In order to maintain a prescribed high temperature corrosion resistance, there has conventionally and generally been used material for stator blades of the industrial gas turbine, which has the chromium content of at least 10.0%, such as "IN738LC" having the chromium content of 16.0%, "IN792" having the chromium content of 12.4%. In the present invention, however, a successful result of the same high temperature corrosion resistance as that of the conventional material can be obtained by limiting the total amount of chromium and rhenium to at least 4%, not withstanding that the chromium content is within a low range of from 3.5% to less than 5%.

Molybdenum (Mo) is an element not only solid-solution strengthener of the gamma-phase, but also for making a gamma-gamma prime lattice misfit ($\gamma/\gamma'$) negative to accelerate the formation of raft structure, which is one of a strengthening mechanism at high temperatures. In the present invention, a molybdenum content is limited to at least 0.5%. It is necessary to contain at least 2% of molybdenum for obtaining required creep strength. With a molybdenum content of over 3.0%, an amount of molybdenum entering into the nickel matrix in solid solution exceeds the prescribed limitation so that the TCP such as $\alpha$-molybdenum, rhenium-molybdenum and the like precipitates. The upper limit of the molybdenum content is therefore limited to 3.0% (not more than 3.0%). It is more preferable to limit the molybdenum content within the range of from 1.0% to 2.5%.

Tungsten (W) is an element of solid-solute strengthener of the gamma-phase. In the present invention, a tungsten content is limited to at least 7.0%. The reason for such limitation is that at least 7.0% of tungsten is necessary for obtaining required creep strength. With a tungsten content of over 10.0%, the TCP precipitates such as $\alpha$-tungsten and chromium-rhenium-tungsten precipitates, degrading the creep strength. The upper limit of the tungsten content is therefore limited to 10.0%. A more preferable tungsten content is within the range of from 8.0% to 9.0%.

Aluminum (Al) is an element for forming gamma prime phase, which is a major strengthening factor of a nickel-base precipitation hardening superalloy and which is also an element forming an aluminum oxide on the surface of the alloy to contribute to improvements in oxidation resistance. In the present invention, the aluminum content of at least 4.5% is required to obtain a required creep characteristic property and a required oxidation resistance. With an aluminum content of over 6%, the range of heat treatment temperature for solid solution treatment is made narrowed, deteriorating the heat treatment properties. The aluminum content is therefore limited within the range of from 4.5% to 6.0%. A more preferable aluminum content is within the range of from 5.0% to 5.5%.

Titanium (Ti) is an element which is replaced by aluminum in the gamma prime phase to form $Ni_3$ (Al, Ti), thereby serving as solid-solute strengthener of the gamma prime phase. In the present invention, the reason for defining that a titanium content is within the range of from 0.1% to 2.0% is that an excessive addition of titanium facilitates production of eutectic gamma prime phase or deposition of $Ni_3Ti$-phase (η-phase) and titanium nitride, hence deteriorating a creep strength. A more preferable titanium content is within the range of from 0.1% to 1%.

Tantalum (Ta) is an element which enters mainly into the gamma prime phase in solid solution to strengthen the gamma prime phase and contributes to oxidation resistance. An amount of at least 5.0% of tantalum is required to obtain the prescribed creep strength in the present invention. Addition of tantalum in an amount of over 8.0% facilitates production of eutectic gamma prime phase, resulting in a narrowed range of temperature at which a heat treatment process can be carried out in the solution heat treatment. The tantalum content is therefore limited within the range of from 5.0% to 8.0%. Further, in the present invention, control of the contents of gamma prime phase generation elements such as titanium, tantalum and the like, and the contents of gamma prime phase-strengthening elements in solid solution, such as chromium, molybdenum, tungsten, rhenium and the like facilitates growth of raft structure having a stress axis to which gamma prime of precipitation particles connects perpendicularly when stress such as creep is applied, thus improving a creep property in comparison with the conventional alloy. The formation of raft structure is under the influence of a gamma-gamma prime lattice misfit, which is a difference in lattice size between the gamma prime phase and the gamma-phase. In the present invention, adjustment of contents of aluminum, tantalum and titanium, which are the gamma prime phase generation elements, controls the lattice misfit. In a case where the titanium content is within the range of from 0.1% to 1.0%, the tantalum content is preferably within the range of from 6.0% to 7.0%. In a case where the titanium content is within the range of 0.8% to 1.5%, the tantalum content is preferably within the range of from 5.0% to less than 6.0%.

Rhenium (Re) is an element for strengthening the gamma-phase in solid solution and for improving high-temperature corrosion resistance. The reasons for the limitations of the rhenium content of from 1.0% to 3.0% will be described hereunder. An amount of at least 1.0% of rhenium is required to obtain the prescribed creep strength in the present invention. Addition of rhenium of over 3.0%, TCP phase, such as rhenium-molybdenum, rhenium-tungsten, rhenium-chromium-tungsten and the like will be precipitated. More preferable range of the rhenium content is within the range of from 2.0% to 3.0%.

Hafnium (Hf) is an element for improving the grain boundary strength. When a defect such as equiaxed grain, bigrains, high/low angle grain boundary and freckle are formed at the time of casting and subsequent heat treatment of the single-crystal turbine blade and vane, Hafnium strengthen the grain boundary between the defects and matrix. In the present invention, the hafnium content is limited within the range of from 0.01% to 0.5%. Addition of hafnium in an amount of over 0.5% decreases the melting point of a resultant alloy, deteriorating heat treatment characteristics thereof. Addition of hafnium in an amount of less than 0.01% cannot provide the above-described effects. In the present invention, the addition of hafnium in an amount of not more than 0.2% will be most preferable.

Silicon (Si) is an element to form an $SiO_2$ oxide on the surface of the resultant alloy to serve as a protective oxide layer, thus improving oxidation resistance. In the conventional nickel-base single-crystal superalloy, silicon is considered as one of inevitable impurities. Silicon is however intentionally added in the present invention, utilizing silicon effectively in the improvement in oxidation resistance as mentioned above. It is conceivable that the oxide layer of $SiO_2$, which does not easily tend to crack in comparison with the other protective oxide layer, has an effect of improving the creep and fatigue properties. Addition of silicon in an excessively large amount decreases the limitations by which the other elements enter in solid solution. The silicon content is therefore limited within the range of from 0.01% to 0.1. In the present invention, the addition of silicon in an amount of not more than 0.2% will be most preferable.

Niobium (Nb) is mainly dissolved in the gamma prime phase to strengthen the same. In the present invention, although such strengthening is performed mainly by tantalum, the niobium may be substituted therefor for achieving substantially the same functions. In comparison with a case where the tantalum is solely added, the case of adding the niobium as composite, the solution amount may be increased, providing an advantageous effect.

Vanadium (V) is dissolved in the gamma prime phase to strengthen the same. In a case, however, where vanadium is excessively added, the volume fraction of gamma-gamma prime eutectic is increased, and hence, a temperature range at which the heat treatment in the solution heat treatment can be done will be made narrowed.

Furthermore, according to the superalloy of the preferred embodiment of the present invention, the amounts to be added of the elements for forming the gamma prime phase such as titanium, tantalum or like and the elements for strengthening the gamma phase of chromium, molybdenum, tungsten, rhenium or like are adjusted so as to accelerate the formation of the raft structure. Raft structure is made by connecting gamma and gamma prime precipitate normal to a stress axis each other, and this structure seems to improve the creep property. The formation of raft structure has an influence on a gamma-gamma prime lattice misfit, which is a difference in size between the gamma prime phase of precipitation particles and the gamma-phase. In the present invention, the vanadium addition amount is limited to be less than 1.0% (weight) in consideration of the total addition of aluminum, tantalum, titanium and niobium.

Ruthenium (Ru) is an element to be dissolved in the gamma phase so as to strengthen the same. However, the ruthenium element has a high density and increase the specific gravity of alloy, and the addition thereof exceeds over 1.5%, the specific strength of the alloy is decreased. For this reason, the addition of ruthenium is limited to be less than 1.5%.

Carbon (C) is an element for improving the grain boundary strength. When a defect such as equiaxed grain, bigrains, high/low angle grain boundary, sliver and freckle are formed at the time of casting and subsequent heat treatment of the single-crystal turbine blade and vane, Carbon strengthen the grain boundary between the defects and matrix. When the carbon is added by more than 0.1%, a carbide is formed together with elements such as tungsten, tantalum or like contributing to the solid-solution strengthening, the creep strength is degraded and the melting point of the alloy is decreased, thus deteriorating the heat treatment characteristics. For this reason, in the present invention, the addition of the carbon is limited to be less than 0.1%.

Boron (B), as like as carbon (C) mentioned above, is an element for improving the grain boundary strength. When a defect such as equiaxed grain, bigrains, high/low angle grain boundary, sliver and freckle are formed at the time of casting and subsequent heat treatment of the single-crystal turbine blade and vane, Boron strengthen the grain boundary between the defects and matrix. When the boron is added by more than 0.05%, a boride is formed together with elements such as tungsten, tantalum or like contributing to the solid-solution strengthening, the creep strength is degraded and the melting point of the alloy is decreased, thus deteriorating the heat treatment characteristics. For this reason, in the present invention, the addition of the boron is limited to be less than 0.05%.

Zirconium (Zr) is, as like as boron (B) or carbon (C), is an element for improving the grain boundary strength. When a defect such as equiaxed grain, bigrains, high/low angle grain boundary, sliver and freckle are formed at the time of casting and subsequent heat treatment of the single-crystal turbine blade and vane, Zirconium strengthen the grain boundary between the defects and matrix. When the boron is added excessively, the creep strength will be decreased, and for this reason, the addition of the zirconium is limited to be less than 0.1%.

Yttrium (Y), Lanthanum (La) and Cerium (Ce) are elements for improving adhesive property of protective oxide layer, such as $Al_2O_3$, $SiO_2$, $Cr_2O_3$ which were formed on the nickel-base superalloy. In a case where a gas turbine blade manufactured by using the nickel-base superalloy is utilized at non-coating state, the gas turbine blade is subjected to heat cycle due to start-and-stop operation. At such time, the protective oxide layer is likely to be spalled off in accordance with the difference in thermal expansion coefficients between the base metal and the protective oxide layer. However, the addition of the yttrium, lanthanum and cerium improve the adhesive property of the protective oxide layer. On the other hand, the excessive addition thereof will make the solubility of the other elements lower. Accordingly, it is determined that the addition of such yttrium, lanthanum and cerium are limited to be less than 0.1%, respectively.

The method for manufacturing the above-mentioned nickel base single-crystal superalloy comprises the steps of: preparing a nickel-base single-crystal superalloy element material having a chemical composition claimed in any one of the above aspects concerning the nickel-base single-crystal superalloy, from raw materials containing nickel, cobalt, chromium, molybdenum, tungsten, aluminum, titanium, tantalum, rhenium, hafnium and silicon; subjecting the superalloy element material to a solution heat treatment within a temperature range of from 1280° C. to 1350° C. under a condition of a vacuum or inert gas atmosphere; quenching the superalloy element material, which has been subjected to the solution heat treatment; subjecting the superalloy element material thus quenched to a first ageing treatment within a temperature range of from 1100° C. to 1200° C.; and then, subjecting the superalloy element material, which has been subjected to the first ageing treatment, to a second ageing treatment within a temperature range lower than that of the first ageing treatment, thereby obtaining the nickel base single-crystal superalloy.

A multi-step heat treatment or a single-step heat treatment may be carried out, at a temperature which is lower than that of the solution heat treatment by 20° C. to 40° C., prior to the solution heat treatment. With the superalloy of the present invention, the addition in amount of rhenium having a low diffusion rate in the nickel alloy is suppressed to less than 3% to thereby obtain a sufficiently high creep strength even in the first stage preliminary solution heat treatment.

It is preferable to limit a period of time during which the solution heat treatment is carried out up to 10 hours.

Hereunder, description will be given to the influence of the manufacturing process on the alloy properties of the nickel-base single-crystal superalloy.

According to the present invention, the precipitation of the gamma prime phase mainly in the nickel matrix strengthens the alloy. More specifically, in a case where the gamma prime phase is uniformly precipitated in the nickel matrix with the cuboidal form and a size of this precipitate is within the range of from about 0.2 $\mu$m to 0.6 $\mu$m, the highest high-temperature creep strength can be provided. In order to improve the creep strength at a high temperature, it is necessary to subject the alloy to the solution heat treatment to cause the gamma prime phase having a non-uniform shape, which has been precipitated during the casting process, to enter once into the nickel matrix in a solid solution and then to reprecipitate the gamma prime phase in a desired shape and size.

In view of this fact, the alloy is subjected to the solution heat treatment in which the alloy is heated to a temperature exceeding a melting temperature of the gamma prime phase to cause the gamma prime phase into the nickel matrix in the solid solution. The solution heat treatment, which is carried out at the temperature immediately below the melting temperature of the gamma phase, actually causes the gamma phase into the nickel matrix in the solid solution and reduces the period of time required for making the structure uniform, thus providing industrially useful effects.

On the other hand, mechanical strain is induced when machining the nickel-base single-crystal superalloy into turbine rotor and stator blades, applying a machine work to portions into which the blades are to be embedded and carrying out a blast working to clean the surfaces of the blades upon a coating process. The mechanical strain generated in the blast machining causes recrystallization to occur in the high-temperature treatment, degrading the creep strength. In view of this fact, it is preferable to carry out the solution heat treatment at the highest temperature by which no recrystallization occurs. However, a degree of mechanical strain introduced may vary in a prescribed range and the temperature by which recrystallization occurs may also vary. In addition, the alloy according to the present invention is locally melted at a temperature of at least 1350° C. The temperature range for the solution heat treatment is therefore limited within the range of from 1280° C. to 1350° C.

In usual, the first ageing treatment functions also as diffusion heat treatment of coating. The temperature for the first ageing treatment is therefore limited within the range of from 1100° C. to 1200° C. in the present invention, taking into consideration the coating applicability. A more preferable temperature for the first ageing treatment is 1150° C.

In addition, application of the multi-step heat treatment in different temperatures during the solution heat treatment permits to carry out the solution heat treatment at an increased high temperature without occurrence of partial melting. It is therefore possible to make the alloy microstructure uniform and precipitate the gamma prime phase having a rectangular shape and a uniform size. As a result, there can be obtained the nickel-base single-crystal superalloy having an excellent creep strength.

The content of rhenium having a low diffusion rate in the nickel alloy is limited up to 3% in the present invention. It is therefore possible to provide a remarkably high creep property even when the single step heat treatment is carried out.

It is preferable to carry out the solution heat treatment for a long period of time to diffuse the added elements, in order to make the alloy structure of the nickel-base single-crystal superalloy uniform. The extended period of time for the heat treatment leads to an increased cost. It is possible to obtain a uniform structure by carrying out the heat treatment within 10 hours in the solution heat treatment in a temperature range from 1280° C. to 1350° C., due to the fact that the content of rhenium having a low diffusion rate in the nickel alloy is limited up to 3% in the present invention.

In addition, it is preferable to make high temperature (heat resisting) gas turbine parts of the nickel-base single-crystal superalloy of the present invention having the above-described composition.

It is also preferable to make a high temperature (heat resisting) gas turbine part of the nickel-base single-crystal superalloy, which has been manufactured in accordance with the above-described method of the present invention for manufacturing such a superalloy.

It is to be noted that the nature and further characteristic features of the present invention will be made more clear from the following descriptions made with references of preferred embodiments and accompanying drawings.

DESCRIPTION OF THE PREFERRED EMBODIMENTS

Preferred embodiments of the present invention will be described in detail hereunder with reference to FIGS. 1 to 4 and TABLES 1 to 13.

Figure 1:
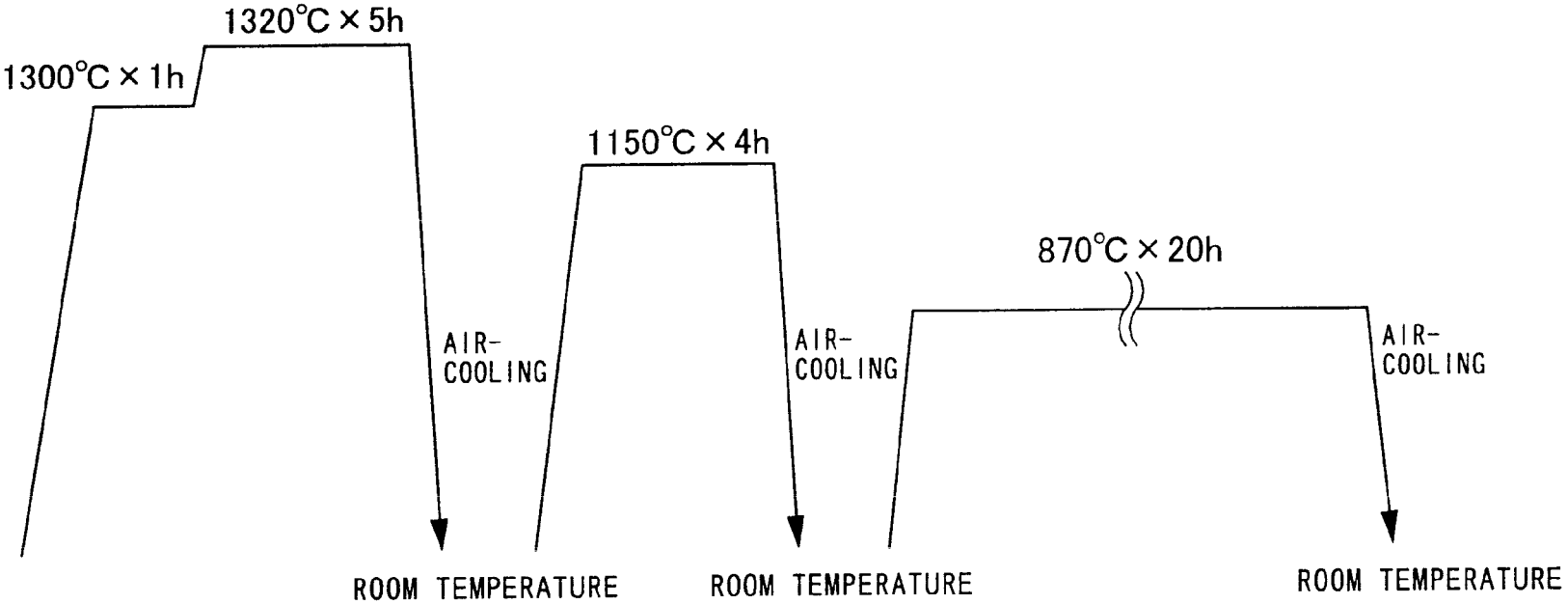
FIG. 1 is a diagram showing a heat treatment sequence with respect to examples of the invention and comparative examples in a first embodiment of the present invention.
Figure 2:
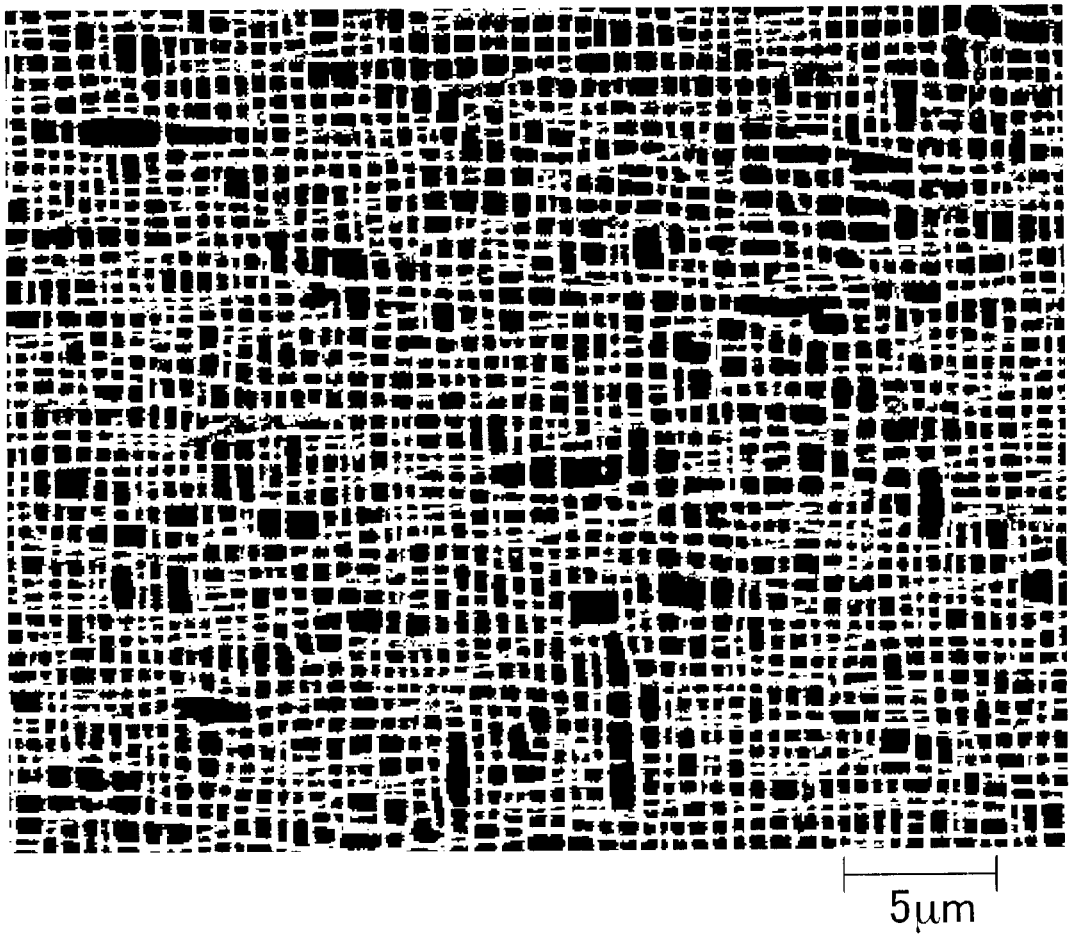
FIG. 2 is a photograph showing a structure in cross section of an alloy of a sample of the invention after completion of a high-temperature ageing test.
Figure 3:
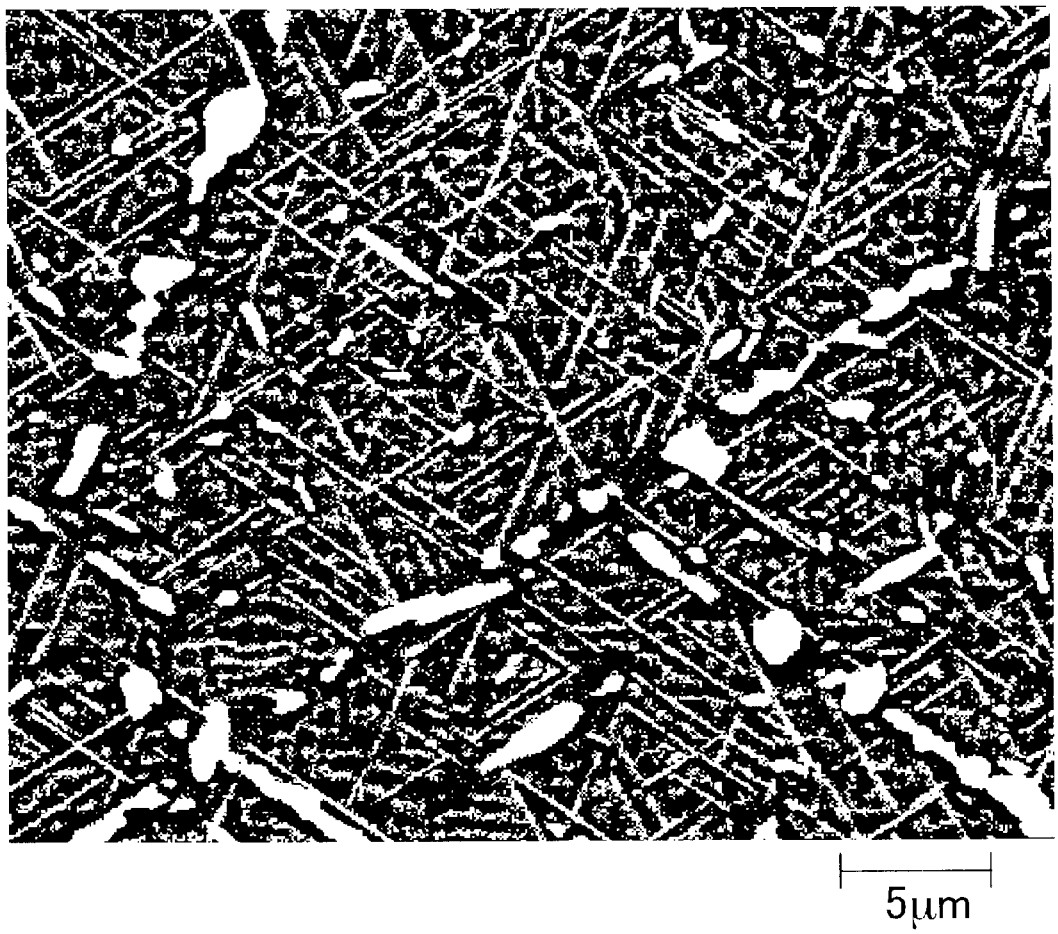
FIG. 3 is a photograph showing a structure in cross section of an alloy of a comparative example after completion of a high-temperature ageing test.

First Embodiment (FIGS. 1 to 3 and TABLES 1 to 5)

In the embodiment in which Samples No. 1 to 32 including alloy Samples of the present invention, alloy Samples for comparison and the conventional (prior art) alloy, there was recognized that the Samples of the embodiments having the compositions within the ranges of alloy compositions according to the present invention exhibited an excellent creep strength and an excellent structural stability as well as substantially the same high-temperature corrosion resistance as that of the conventional alloy.

TABLE 1

(weight %)

| | | Co | Cr | Mo | W | Al | Ti | Ta | V | Nb | Re | Ru | Si | Hf | Ni |
|---|---|---|---|---|---|---|---|---|---|---|---|---|---|---|---|
| Example | No.1 | 7.7 | 4.6 | 1.9 | 8.7 | 5.3 | 0.5 | 6.4 | — | — | 2.4 | — | 0.01 | 0.1 | Bal. |
| | No.2 | 7.5 | 4.7 | 1.9 | 8.5 | 5.4 | 0.5 | 5.8 | — | — | 2.4 | — | 0.01 | 0.1 | Bal. |
| | No.3 | 5.0 | 4.8 | 1.5 | 9.8 | 5.0 | 0.9 | 6.2 | — | — | 1.0 | — | 0.01 | 0.1 | Bal. |
| | No.4 | 5.0 | 4.7 | 1.9 | 8.7 | 5.2 | 0.9 | 5.9 | — | — | 2.4 | — | 0.05 | 0.1 | Bal. |
| | No.5 | 9.8 | 4.8 | 1.5 | 7.1 | 5.3 | 0.5 | 6.1 | — | — | 2.3 | — | 0.01 | 0.1 | Bal. |
| | No.6 | 9.9 | 4.0 | 1.5 | 7.1 | 5.3 | 0.5 | 6.1 | — | — | 2.9 | — | 0.01 | 0.05 | Bal. |
| | No.7 | 9.9 | 4.8 | 1.5 | 7.5 | 5.9 | 0.1 | 5.2 | — | — | 2.4 | — | 0.01 | 0.05 | Bal. |
| | No.8 | 9.8 | 4.0 | 2.9 | 7.8 | 5.1 | 0.4 | 5.4 | — | — | 2.4 | — | 0.01 | 0.02 | Bal. |
| | No.9 | 9.8 | 4.0 | 1.5 | 7.2 | 5.1 | 0.1 | 7.8 | — | — | 2.4 | — | 0.01 | 0.02 | Bal. |
| | No.10 | 7.6 | 4.8 | 1.4 | 8.7 | 5.1 | 0.8 | 6.3 | — | — | 2.4 | — | 0.01 | 0.4 | Bal. |
| | No.11 | 7.6 | 4.5 | 1.8 | 8.6 | 5.3 | 0.8 | 5.8 | — | — | 2.4 | — | 0.01 | 0.1 | Bal. |
| | No.12 | 7.5 | 4.4 | 1.6 | 8.5 | 5.2 | 0.8 | 5.7 | — | — | 2.2 | — | 0.01 | 0.2 | Bal. |
| | No.13 | 4.0 | 4.8 | 1.8 | 8.7 | 5.4 | 0.5 | 6.3 | — | — | 2.5 | — | 0.01 | 0.1 | Bal. |
| | No.14 | 11.0 | 4.6 | 1.7 | 8.6 | 5.1 | 0.4 | 6.2 | — | — | 2.4 | — | 0.01 | 0.1 | Bal. |
| | No.15 | 7.7 | 4.6 | 1.9 | 8.2 | 5.2 | 0.4 | 5.1 | 0.9 | — | 2.4 | — | 0.05 | 0.1 | Bal. |
| | No.16 | 7.4 | 4.7 | 1.8 | 8.6 | 5.0 | 0.4 | 6.0 | — | 1.9 | 2.4 | — | 0.05 | 0.1 | Bal. |
| | No.17 | 7.7 | 4.7 | 1.5 | 7.5 | 5.0 | 0.5 | 6.4 | — | — | 2.4 | 1.5 | 0.05 | 0.1 | Bal. |
| Comparative Example | No.18 | 8.0 | 6.1 | 1.9 | 5.0 | 6.2 | — | 7.2 | — | — | 5.1 | — | 0.01 | 0.2 | Bal. |
| | No.19 | 7.0 | 4.0 | — | 8.0 | 5.2 | 0.2 | 6.0 | — | — | 2.0 | — | 0.01 | 0.1 | Bal. |
| | No.20 | 3.8 | 6.8 | 4.0 | 11.0 | 5.3 | 0.5 | 7.2 | — | — | 5.0 | — | 0.01 | 0.2 | Bal. |
| | No.21 | 11.5 | 4.0 | 2.0 | 5.0 | 6.2 | 1.5 | 8.5 | — | — | 2.4 | — | 0.01 | 0.2 | Bal. |
| | No.22 | 5.0 | 2.0 | 1.0 | 2.2 | 5.3 | 0.5 | 6.4 | — | — | 0.1 | — | 0.01 | 0.01 | Bal. |
| | No.23 | 6.8 | 1.5 | 1.2 | 2.0 | 4.3 | 0.1 | 2.0 | — | — | 2.0 | — | 0.01 | 0.01 | Bal. |
| | No.24 | 7.0 | 4.5 | 1.2 | 8.5 | 5.4 | 0.9 | 6.0 | — | — | 3.0 | — | 0.01 | — | Bal. |
| | No.25 | 6.8 | 4.8 | 1.2 | 7.5 | 2.4 | 0.5 | 2.1 | — | — | 2.4 | — | 0.01 | 0.25 | Bal. |
| | No.26 | 8.0 | 4.9 | 2.5 | 8.9 | 5.2 | 0.5 | 6.1 | — | — | 2.6 | — | 0.01 | 0.1 | Bal. |
| | No.27 | 5.0 | 4.8 | 1.5 | 9.8 | 4.5 | 0.9 | 6.2 | — | — | 1.0 | — | — | 0.1 | Bal. |
| | No.28 | 3.1 | 4.7 | 1.9 | 8.7 | 5.5 | 4.0 | 5.9 | — | — | 2.4 | — | — | 0.1 | Bal. |
| | No.29 | 7.7 | 4.9 | 2.0 | 8.8 | 5.3 | 0.5 | 6.5 | — | — | 2.3 | — | 2.0 | 0.1 | Bal. |
| | No.30 | 7.7 | 4.6 | 1.5 | 8.6 | 5.2 | 0.5 | 6.4 | 4.0 | — | 2.4 | — | 0.05 | 0.1 | Bal. |
| | No.31 | 7.4 | 4.7 | 1.8 | 8.7 | 5.2 | 0.5 | 6.3 | — | 4.0 | 2.4 | — | 0.05 | 0.1 | Bal. |
| | No.32 | 7.5 | 4.6 | 1.7 | 8.5 | 5.3 | 0.5 | 6.2 | — | — | 2.4 | 5.0 | 0.05 | 0.1 | Bal. |
| Conventional Example (CMSX-4) | No.33 | 9.0 | 6.5 | 0.6 | 6.0 | 5.6 | 1.0 | 6.5 | — | — | 3.0 | — | — | 0.1 | Bal. |

Examples of the Invention (Samples Nos. 1 to 17)

In the Example of the present invention, Samples Nos. 1 to 17 as shown in TABLE 1 were used.

Samples Nos. 1 to 14 of a nickel-base single-crystal superalloy essentially consists of, in percentages by weight, 4.0% to 11.0% cobalt, 3.5% to less than 5.0% chromium, 0.5% to 3.0% molybdenum, 7.0% to 10.0% tungsten, 4.5% to 6.0% aluminum, 0.1% to 2.0% titanium, 5.0% to 8.0% tantalum, 1.0% to 3.0% rhenium, 0.01% to 0.5% hafnium, 0.01% to 0.1% silicon, and the balance being nickel and inevitable impurities. The total amount of rhenium and chromium is at least 4.0% and the total amount of rhenium, molybdenum, tungsten and chromium is up to 18.0%.

Samples Nos. 15, 16 and 17 are ones prepared by adding vanadium of not more than 1%, adding niobium of not more than 2.0% and adding ruthenium of not more than 2% respectively to the Sample Nos. 1 to 14 mentioned above.

Conventional Examples (Samples Nos. 18 to 32)

In the Conventional Examples, there were used Samples Nos. 18 to 32, which have the composition outside the range of the alloy composition of the present invention as shown in TABLE 1.

Conventional Example (Sample No. 33)

In the Conventional Example, "CMSX-4" of the single-crystal alloy of the second generation is used as Sample No. 27. More specifically, the alloy consists essentially, in percentages by weight, 9.0% cobalt, 6.5% chromium, 0.6% molybdenum, 6.0% tungsten, 5.6% aluminum, 1.0% titanium, 6.5% tantalum, 3.0% rhenium, 0.1% hafnium and the balance being nickel and inevitable (unavoidable) impurities.

With respect to each of the alloys having the compositions of the Examples of the present invention and the Conventional Examples mentioned above, there was prepared a melting stock in which contents of raw materials were adjusted in an appropriate rate so as to provide the composition such as shown in TABLE 1. A round bar-shaped single-crystal alloy Sample was prepared from the thus prepared melting stock as the raw material through a drawing method. With respect to the Conventional Example, a master metal having the composition as shown in TABLE 1 was purchased and a round bar-shaped single-crystal alloy Sample was prepared through the same drawing method as in the Examples of the present invention and the Conventional Examples.

Each of the resultant single-crystal alloy Samples Nos. 1 to 32 was etched with the use of the mixed solution consisting of hydrochloric acid and aqueous hydrogen peroxide. It was confirmed, through visual inspection, that the whole Sample was single-crystallized and that the direction of growth in crystal had an angle of up to 10 degrees with respect to the drawing direction. After such inspection, a heat treatment was carried out in accordance with a sequence as shown in FIG. 1.

FIG. 1 is a diagram showing a heat treatment sequence with respect to the Examples of the present invention and the Conventional Examples.

As shown in FIG. 1, each of Samples Nos. 1 to 32 of the Examples of the present invention and the Conventional Examples was subjected to a preliminary solution heat treatment at a temperature of 1300° C. for 1 hour to prevent the alloy from incipient melting. The alloy is then subjected to a solution heat treatment at a temperature of 1320° C., which is equal to or higher than the dissolution temperature of the gamma prime phase of the respective alloy and equal to or lower than the melting point of the gamma phase thereof for 5 hours.

After completion of the solution heat treatment, each Sample was air-cooled up to room temperature. The Sample thus air-cooled was then subjected to a first ageing treatment at a temperature of 1150° C. for 4 hours for the purpose of precipitating the gamma prime phase. Then, a second ageing treatment was carried out at a temperature of 870° C. for 20 hours for the purpose of stabilizing the gamma prime phase.

After completion of the above-mentioned heat treatment, a creep rupture test, a high-temperature corrosion resistance test and an ageing test serving as a high-temperature oxidation test were carried out with respect to the Samples thus prepared.

In the creep rupture test, the test was conducted under the condition of 1100° C. and 137 MPa stress in the atmosphere to determine a creep rupture life (h), extension (%) and reduction of area (%) of the alloy. In the high-temperature corrosion resistance test, the Sample was soaked for 20 hours into a molten salt having a composition of 75% sodium sulfate and 25% sodium chloride, which had been heated to a temperature of 900° C. Then, the resultant Sample was subject to a descaling process. In this case, an amount of decreased mass due to corrosion was determined. The resultant amount of decreased mass was converted into an amount of corrosion (mm). Furthermore, in the high-temperature oxidation test, the Sample was kept at a temperature of 1000° C. for 800 hours, and then, the structure of the Sample in its cross section was observed so that a thickness of the oxide scale in which no spalling occurred is measured. In the high temperature ageing test, the Sample was kept at a temperature of 1000° C. for 800 hours, and then, the structure of the Sample in its cross section was observed so that volume fraction of TCP phase of at least 5% was recognized. The obtained results are shown in TABLES 2 to 5 as well as FIGS. 2 and 3.

TABLE 2 shows the results of the creep rupture test for the alloys of the Examples of the present invention, the Conventional Examples and the Conventional Example.

TABLE 2

| Sample | | Creep Rupture Life (h) | Extension (%) | Contraction (%) |
|---|---|---|---|---|
| Example | No. 1 | 374.2 | 9.0 | 28.6 |
| | No. 2 | 96.2 | 19.5 | 47.0 |
| | No. 3 | 71.8 | 21.0 | 51.2 |
| | No. 4 | 131.8 | 17.0 | 32.8 |
| | No. 5 | 73.0 | 22.2 | 52.0 |
| | No. 6 | 123.9 | 16.5 | 47.0 |
| | No. 7 | 77.4 | 18.5 | 46.5 |
| | No. 8 | 98.2 | 15.5 | 46.8 |
| | No. 9 | 135.2 | 15.8 | 53.2 |
| | No. 10 | 158.6 | 18.1 | 31.9 |
| | No. 11 | 190.2 | 16.8 | 31.7 |
| | No. 12 | 178.2 | 15.1 | 27.6 |
| | No. 13 | 190.5 | 11.0 | 22.6 |
| | No. 14 | 186.9 | 15.4 | 23.5 |
| | No. 15 | 209.5 | 14.8 | 23.6 |
| | No. 16 | 212.6 | 15.6 | 22.6 |
| | No. 17 | 245.6 | 17.3 | 28.9 |
| Comparative Example | No. 18 | 42.6 | 16.4 | 31.2 |
| | No. 19 | 18.9 | 16.8 | 29.0 |
| | No. 20 | 41.8 | 10.2 | 45.6 |
| | No. 21 | 41.9 | 9.5 | 31.2 |
| | No. 22 | 14.0 | 13.9 | 34.7 |
| | No. 23 | 18.7 | 20.2 | 25.2 |
| | No. 24 | 65.6 | 24.6 | 21.8 |
| | No. 25 | 23.9 | 24.6 | 33.6 |
| | No. 26 | 63.5 | 14.7 | 38.3 |
| | No. 27 | 41.0 | 21.2 | 50.1 |
| | No. 28 | 13.7 | 13.5 | 32.6 |
| | No. 29 | 100.9 | 21.5 | 22.5 |
| | No. 30 | 101.7 | 22.6 | 22.7 |
| | No. 31 | 108.9 | 29.0 | 24.5 |
| | No. 32 | 24.8 | 23.4 | 22.4 |
| Conventional Example (CMSX-4) | No. 33 | 42.6 | 35.4 | 34.5 |

As shown in TABLE 2, the creep rupture life determined under the condition of 1100° C. and 137 MPa became long, i.e., 71.8 to 374.2 hours in the Samples of the present invention Nos. 1 to 17, thus revealing an excellent creep characteristic property in comparison with "CMSX-4" of the Conventional Example. It is conceivable from these test results that, in the Examples of the present invention, strengthened by forming the raft structure and addition of silicon can prevent cracks serving as a initiation crack site of creep and low cycle fatigue on the oxide layer.

On the contrary, the Samples Nos. 18 and 20 of the Conventional Examples accompanied precipitation of the TCP phase, which mainly consist of rhenium, molybdenum and tungsten, thus deteriorating the creep rupture life, due to the Sample No. 18 of the Conventional Example having the excessively large contents of chromium and rhenium and the Sample No. 20 of the Conventional Example having the excessively large total amount of chromium, molybdenum, tungsten and rhenium. The Sample No. 26 of the Conventional Example accompanied precipitation of the TCP, thus deteriorating the creep rupture life due to the fact that the total amount of rhenium, molybdenum, tungsten and chromium exceeded 18.9% so as to be outside the scope of the present invention and the amounts of these elements in the solid solution exceeded the prescribed limitations, although the respective contents of these elements were within the ranges according to the present invention.

The Samples Nos. 19, 22, 23 and 25 of the Conventional Examples revealed a lower strength than the conventional alloy due to the fact that, in a case where the contents of the elements were smaller than the lower limits of the ranges of the alloy composition of the present invention as in the Samples Nos. 19, 22 and 23 of the Conventional Examples, non-addition of rhenium, molybdenum and tungsten in solid solution did not provide an effective strengthened result, and on the one hand, in a case where the contents of aluminum and tantalum were insufficient as in the Sample No. 25 of the Conventional Example, precipitation of the gamma prime phase did not provide an effective strengthened result.

TABLE 3 shows the results of high-temperature corrosion test with respect to the alloys of the Examples of the present invention, the Comparative Examples and the Conventional Example.

TABLE 3

| Sample | | Corrosion Amount (mm) |
|---|---|---|
| Example | No. 1 | 0.1 |
| | No. 2 | 0.2 |
| | No. 3 | 0.3 |
| | No. 4 | 0.1 |
| | No. 5 | 0.2 |
| | No. 6 | 0.3 |
| | No. 7 | 0.4 |
| | No. 8 | 0.2 |
| | No. 9 | 0.3 |
| | No. 10 | 0.1 |
| | No. 11 | 0.1 |
| | No. 12 | 0.1 |
| | No. 13 | 0.1 |
| | No. 14 | 0.1 |
| | No. 15 | 0.1 |
| | No. 16 | 0.1 |
| | No. 17 | 0.1 |
| Comparative Example | No. 18 | 0.01 |
| | No. 19 | 0.5 |
| | No. 20 | 0.3 |
| | No. 21 | 0.2 |
| | No. 22 | 5.0 |
| | No. 23 | 4.0 |
| | No. 24 | 0.2 |
| | No. 25 | 0.1 |
| | No. 26 | 0.1 |
| | No. 27 | 0.5 |
| | No. 28 | 0.3 |
| | No. 29 | 0.3 |
| | No. 30 | 2.0 |
| | No. 31 | 1.2 |
| | No. 32 | 0.3 |
| Conventional Example (CMSX-4) | No. 33 | 0.2 |

There were obtained results that, as shown in TABLE 3, any one of the Samples of the invention had an amount of corrosion of up to 0.4 mm and revealed a good corrosion resistance, and on the contrary, the alloys of the Samples Nos. 22 and 23 having the chromium content of up to 3.5% had an amount of corrosion of at least 4 mm, which was larger in comparison with the Samples having the chromium content of at least 3.5%, and revealed a poor high-temperature corrosion resistance.

TABLE 4 shows results of the high-temperature oxidation test for the Examples of the invention, the Comparative Examples and the Conventional Example.

TABLE 4

| Sample | | Oxide Film Thickness ($\mu$m) |
|---|---|---|
| Example | No. 1 | 5 |
| | No. 2 | 5 |
| | No. 3 | 6 |
| | No. 4 | 5 |
| | No. 5 | 4 |
| | No. 6 | 8 |
| | No. 7 | 5 |
| | No. 8 | 8 |
| | No. 9 | 7 |
| | No. 10 | 7 |
| | No. 11 | 8 |
| | No. 12 | 7 |
| | No. 13 | 5 |
| | No. 14 | 5 |
| | No. 15 | 7 |
| | No. 16 | 8 |
| | No. 17 | 8 |
| Comparative Example | No. 18 | 5 |
| | No. 19 | 14 |
| | No. 20 | 5 |
| | No. 21 | 6 |
| | No. 22 | 7 |
| | No. 23 | 24 |
| | No. 24 | 7 |
| | No. 25 | 25 |
| | No. 26 | 6 |
| | No. 27 | 11 |
| | No. 28 | 12 |
| | No. 29 | 5 |
| | No. 30 | 5 |
| | No. 31 | 6 |
| | No. 32 | 9 |
| Conventional Example (CMSX-4) | No. 33 | 10 |

As shown in TABLE 4, the Samples of the Examples of the present invention, which had the aluminum content of at least 5% and contained silicon, had a thickness of oxide film of 5 to 8 $\mu$m and revealed a good oxidation resistance in comparison with the Samples Nos. 27 and 28 of the Comparative Examples containing no silicon.

TABLE 5 shows the evaluation results of microstructural stability after the high temperature ageing test for the Examples of the present invention, the Comparative Examples and the Conventional Example. FIG. 2 is a photograph showing a structure in cross section of the Samples of the present invention and FIG. 3 is a photograph showing a structure in cross section of the Samples of the Comparative Examples.

TABLE 5

| Sample | | Presence or Absence of Deteriorated Phase Precipitation (more than 5%) |
|---|---|---|
| Example | No. 1 | Absence |
| | No. 2 | Absence |
| | No. 3 | Absence |
| | No. 4 | Absence |
| | No. 5 | Absence |
| | No. 6 | Absence |
| | No. 7 | Absence |
| | No. 8 | Absence |
| | No. 9 | Absence |
| | No. 10 | Absence |
| | No. 11 | Absence |
| | No. 12 | Absence |
| | No. 13 | Absence |
| | No. 14 | Absence |
| | No. 15 | Absence |
| | No. 16 | Absence |
| | No. 17 | Absence |
| Comparative Example | No. 18 | Presence |
| | No. 19 | Absence |
| | No. 20 | Presence |
| | No. 21 | Presence |
| | No. 22 | Absence |
| | No. 23 | Absence |
| | No. 24 | Absence |
| | No. 25 | Absence |
| | No. 26 | Presence |
| | No. 27 | Presence |
| | No. 28 | Absence |
| | No. 29 | Presence |
| | No. 30 | Presence |
| | No. 31 | Presence |
| | No. 32 | Presence |
| Conventional Example (CMSX-4) | No. 33 | Absence |

As shown in TABLE 5, in the Samples of the present invention, there was recognized no precipitation of the TCP phase of at least 5% even after the lapse of holding time of 1000 hours and there was recognized, as typically shown in FIG. 3, precipitation of only the gamma prime phase having the rectangular shape in the nickel matrix, thus providing a good structure. On the contrary, there was observed precipitation of the TCP phase in the Conventional Examples and there was revealed that the TCP phase precipitated had a plate or needle-shape as typically shown in FIG. 3, deteriorating a structural stability.

According to the Examples of the present invention, it is therefore possible to provide the nickel-base single-crystal superalloy having the improved creep strength and the improved structural stability at high temperatures by limiting the composition within the range of the present invention.

Figure 4:
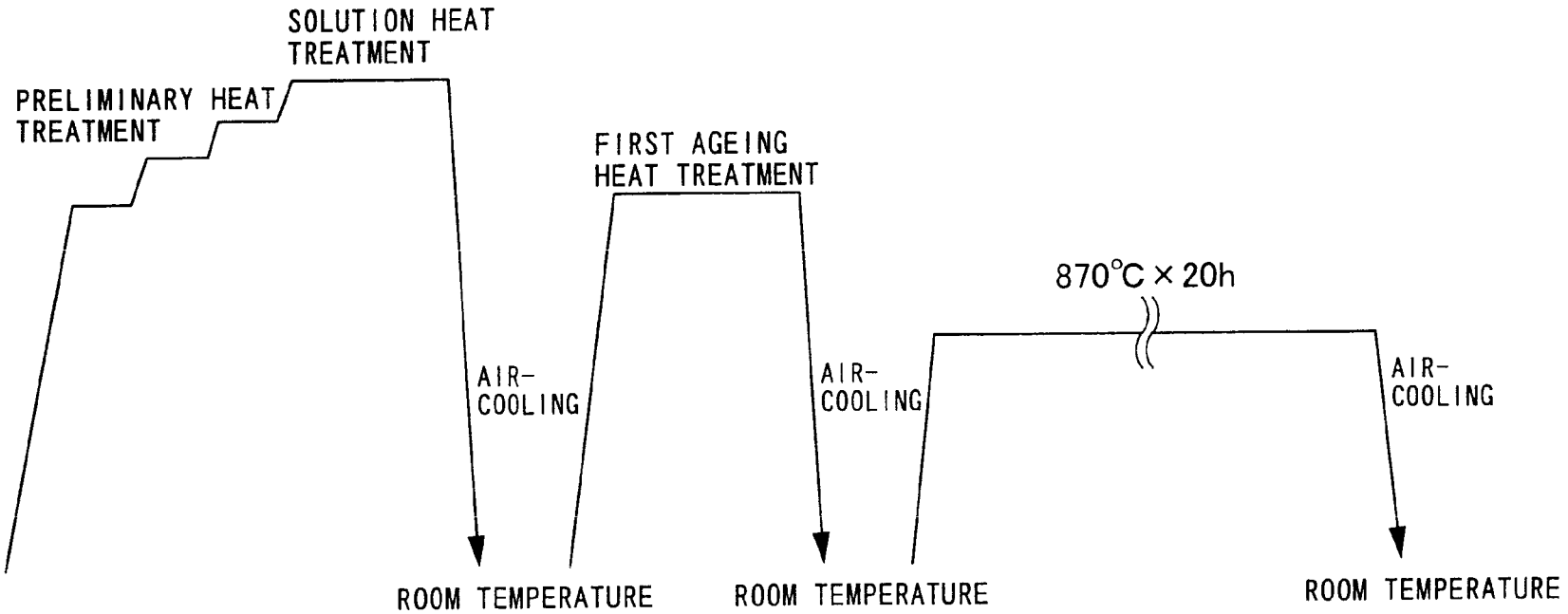
FIG. 4 is a diagram showing a heat treatment sequence in a second embodiment of the present invention.

Second Embodiment (FIG. 4 and TABLES 6 to 8)

It was confirmed from the embodiment that the nickel-base single-crystal superalloy manufactured in accordance with the method of the present invention for manufacturing such an alloy had an excellent creep strength.

There was prepared a melting stock of 40 kg serving as the raw material for the purpose of obtaining the composition of the alloy of the Sample No. 1 as shown in TABLE 1. TABLE 6 shows results of analysis of the composition of the alloy.

TABLE 6

(weight %)

| | Co | Cr | Mo | W | Al | Ti | Ta | Re | Si | Hf | Ni |
|---|---|---|---|---|---|---|---|---|---|---|---|
| Melting Stock | 7.8 | 4.9 | 1.9 | 8.7 | 5.3 | 0.5 | 6.4 | 2.4 | 0.01 | 0.1 | Bal. |

As shown in TABLE 6, the melting stock essentially consisting of, in percentages by weight, 7.8% cobalt, 4.9% chromium, 1.9% molybdenum, 8.7% tungsten, 5.3% aluminum, 0.5% titanium, 6.4% tantalum, 2.4% rhenium, 0.1% hafnium, 0.01% silicon, and the balance being nickel and inevitable impurities.

A round bar-shaped single-crystal alloy sample was prepared with the use of the thus prepared melting stock through a drawing method. Each of the resultant single-crystal alloy samples was etched with the use of the mixed solution consisting of hydrochloric acid and aqueous hydrogen peroxide. It was confirmed, through a visual inspection, that the sample was entirely single-crystallized and that the direction of growth in crystal had an angle of up to 10 degree with respect to the drawing direction.

After such inspection, a heat treatment was applied to each of the samples in accordance with sequence shown in FIG. 4. The conditions for the heat treatments as shown in TABLE 7 were applied as the conditions for the respective heat treatments for the Samples of the present invention and the Conventional Examples.

TABLE 7

| Sample | Preliminary Heat Treatment | Solution Heat Treatment | First Ageing Heat Treatment |
|---|---|---|---|
| Example | | | |
| No.34 | 1300° C. × 1 h | 1320° C. × 5 h | 1150° C. × 4 h |
| No.35 | 1300° C. × 1 h | 1320° C. × 5 h | 1100° C. × 4 h |
| No.36 | 1280° C. × 1 h | 1300° C. × 5 h | 1150° C. × 4 h |
| No.37 | 1280° C. × 1 h | 1300° C. × 5 h | 1100° C. × 4 h |
| No.38 | 1320° C. × 1 h | 1340° C. × 5 h | 1150° C. × 4 h |
| No.39 | 1260° C. × 1 h | 1280° C. × 5 h | 1100° C. × 4 h |
| No.40 | 1280° C. × 1 h→1290° C. × 1 h→1300° C. × 1 h | 1320° C. × 5 h | 1150° C. × 4 h |
| No.41 | 1280° C. × 1 h | 1320° C. × 5 h | 1150° C. × 4 h |
| No.42 | 1300° C. × 1 h | 1300° C. × 5 h | 1150° C. × 4 h |
| Comparative Example | | | |
| No.43 | 1170° C. × 1 h | 1190° C. × 5 h | 1100° C. × 4 h |
| No.44 | 1340° C. × 1 h | 1360° C. × 5 h | 1100° C. × 4 h |
| No.45 | 1300° C. × 1 h | 1300° C. × 5 h | 900° C. × 4 h |
| No.46 | 1300° C. × 1 h | 1320° C. × 5 h | 1250° C. × 4 h |

As shown in TABLE 7, the Samples Nos. 34 to 40 of the Examples of the invention were prepared by limiting the temperature of the solution heat treatment within the range of from 1280° C. to 1350° C. and limiting the temperature of the first ageing heat treatment within the range of from 1100° C. to 1200° C., so as to be within the scope of the present invention. Of the above-mentioned Samples, the Samples Nos. 28 to 41 were prepared by limiting the temperature of the preliminary solution heat treatment to a temperature, which is lower than that of the solution heat treatment by 20° C. to 60° C., prior to the solution heat treatment. On the contrary, with respect to the Samples Nos. 43 to 46 of the Comparative Examples, the conditions of the heat treatments were outside the scope of the present invention.

A heat treatment was applied to each of the Samples Nos. 34 to 46. After completion of such a heat treatment, each Sample was subjected to a creep rupture test under the condition of a temperature of 1100° C. and 137 MPa stress in the Ar gas atmosphere to determine a creep rupture life (h). The test conditions were the same as those in the first embodiment. The test results are shown in TABLE 8.

TABLE 8

| Sample | | Creep Rupture Life (h) |
|---|---|---|
| Example | No. 34 | 374.2 |
| | No. 35 | 245.5 |
| | No. 36 | 221.2 |
| | No. 37 | 58.5 |
| | No. 38 | 335.8 |
| | No. 39 | 236.1 |
| | No. 40 | 398.6 |
| | No. 41 | 241.5 |
| | No. 42 | 371.4 |
| Comparative Example | No. 43 | 128.6 |
| | No. 44 | 89.7 |
| | No. 45 | 129.0 |
| | No. 46 | 68.9 |

As shown in TABLE 8, the Samples Nos. 34 to 42 of the Examples of the present invention, which had been subjected to the solution heat treatment at a temperature range of from 1280° C. to 1340° C., had a long creep rupture life, leading to a good creep rupture property. On the contrary, the Sample No. 43, which had been subjected to the solution heat treatment at a temperature of less than 1280° C., revealed a deteriorated creep rupture life, due to insufficient segregation of the elements in the alloy and an insufficient amount of gamma prime phase entered into the nickel matrix in solid solution, with the result that the gamma prime phase could not have an effective shape for improving the strength. The Sample No. 44, which had been subjected to the solution heat treatment at a temperature of over 1350° C., revealed a deteriorated creep rupture life, due to the fact that a starting point of rupture was made by porosities, which occurred through incipient melting of the eutectic gamma prime phase having a lower melting point relative to the nickel matrix. The Sample No. 45, which had been subjected to the solution heat treatment within the scope of the present invention, but to the first ageing treatment at a temperature of 900° C., revealed a deteriorated creep rupture life (strength) due to a small amount of gamma prime phase precipitated. The Sample No. 46, which had been subjected to the solution heat treatment within the scope of the present invention, but to the first ageing treatment at a temperature of 1250° C., revealed a deteriorated creep rupture life due to a large size of the gamma prime phase precipitated.

According to the embodiment of the present invention, it is therefore possible to impart an excellent creep rupture life to the alloy by limiting the conditions of the heat treatments within the scope of the present invention.

Figure 5:
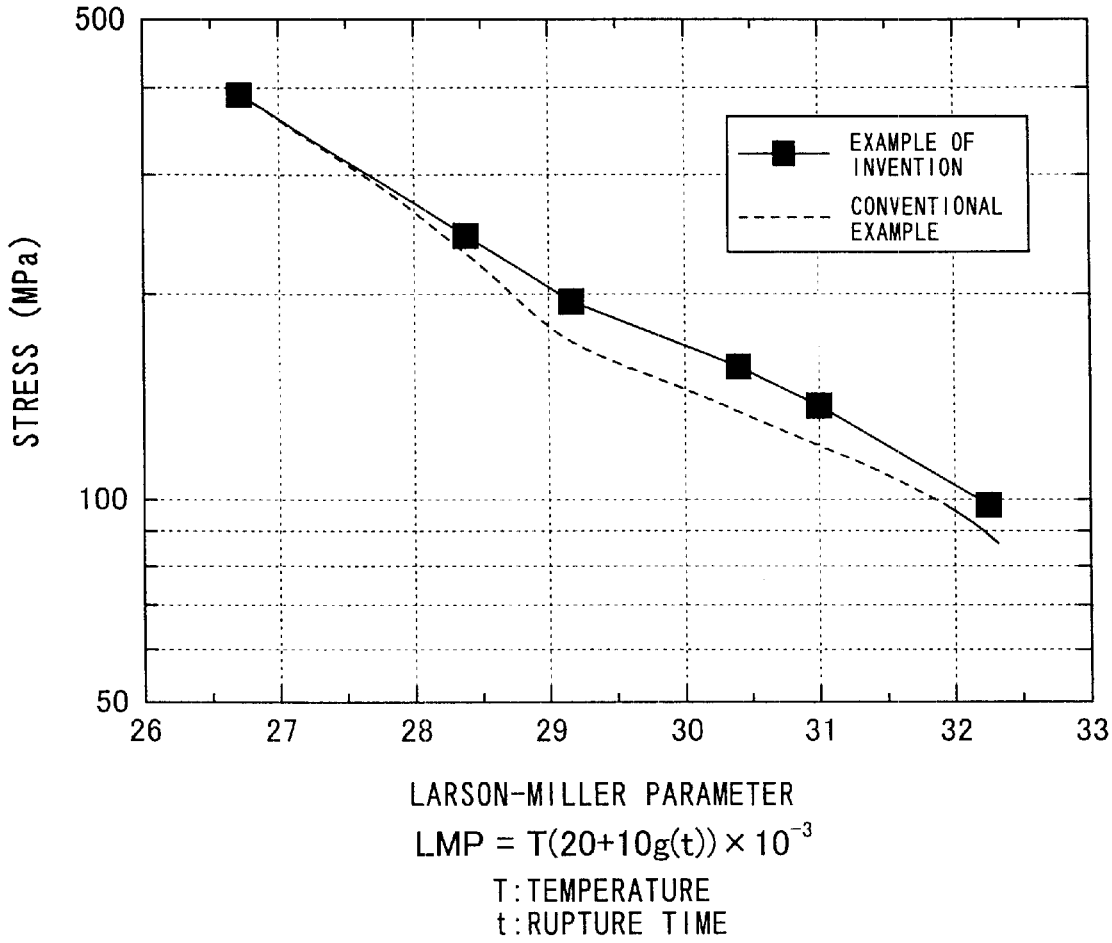
FIG. 5 is a diagram showing creep characteristic properties in comparison of an example of the invention with the conventional example with respect to a third embodiment of the present invention.

Third Embodiment (FIG. 5 and TABLE 9)

It was confirmed from the embodiment that the nickel-base single-crystal superalloy, which had the alloy composition within the scope of the present invention and had been manufactured by the manufacturing method of the present invention in accordance with the conditions of the heat treatments within the scope of the present invention, had an excellent creep strength even under the condition of a temperature of from 900° C. to 1100° C. and a stress region of from 98 MPa to 392 MPa.

In the embodiment, a round bar-shaped single-crystal alloy sample having a diameter of 9 mm and a length of 100 mm was prepared with the use of the same melting stock as in the second embodiment through a drawing method. Each of the resultant samples was etched with the use of the mixed solution consisting of hydrochloric acid and aqueous hydrogen peroxide. It was confirmed, through the visual inspection, that the sample was entirely single-crystallized and that the direction of growth in crystal had an angle of up to 10 degree with respect to the drawing direction.

After such inspection, each of the samples was subjected to a preliminary solution heat treatment at a temperature of 1300° C. for one hour and then to a solution heat treatment at a temperature of 1320° C. for 5 hours. Thereafter, the resultant sample was subjected to the first ageing treatment at a temperature of 1150° C. for 4 hours and then to the second ageing treatment at a temperature of 870° C. for 20 hours.

After completion of the above-mentioned heat treatments, a creep test was carried out. Creep test conditions shown in TABLE 9 were applied to the Samples Nos. 47 to 52. The results are shown in TABLE 9 and FIG. 5.

TABLE 9

| Sample | Test Condition | Creep Rupture Life (h) | Extension (%) | Contraction (%) |
|---|---|---|---|---|
| No. 47 | 1100° C./137MPa | 347.8 | 9.0 | 28.6 |
| No. 48 | 1000° C./196MPa | 789.9 | 19.9 | 28.6 |
| No. 49 | 1100° C./98MPa | 2987.2 | 9.1 | 30.6 |
| No. 50 | 900° C./392MPa | 584.3 | 23.5 | 29.5 |
| No. 51 | 1100° C./156.8MPa | 136.4 | 13.5 | 29.8 |
| No. 52 | 1000° C./245MPa | 198.4 | 23.4 | 28.2 |

In the conventional Example, the creep data of "CMSX-4" described in "DS AND SC SUPERALLOYS FOR INDUSTRIAL GAS TURBINES"; G. L. Erickson and K. Harris: Materials for Advanced Power Engineering 1994 were used. The data are also shown in FIG. 5. The abscissa in FIG. 5 indicates Larson-Miller parameter (LMP), i.e., a parameter of temperature and rupture time and the ordinate therein indicates stress.

As shown in FIG. 5, the Samples of the present invention had a more excellent creep rupture life than the CMSX-4 of the Conventional Example under the creep test conditions of a temperature of at least 900° C. and a stress range of up to 200 MPa.

The embodiment revealed that, according to the present invention, it was possible to provide the nickel-base single-crystal superalloy, which had substantially the same creep strength as the CMSX-4 at a temperature of up to 900° C. and a stress of at least 200 MPa, and had a more improved creep rupture life than that of the second generation single-crystal superalloy at the temperature of at least 900° C. and a stress of up to 200 MPa, thus providing more excellent properties than the conventional alloy.

Fourth Embodiment (Tables 10 and 11)

This fourth embodiment represents a nickel-base single-crystal superalloy essentially consisting of any one of yttrium, lanthanum and cerium in addition to cobalt, chromium, molybdenum, tungsten, aluminum, titanium, tantalum, rhenium, hafnium and silicon and the balance of nickel and inevitable impurity. As a material, there was used one prepared by adding one of yttrium, lanthanum and cerium to the melting stock shown in TABLE 6.

TABLE 10

| | | Co | Cr | Mo | W | Al | Ti | Ta | Re | Si | Hf | Y | La | Ce | Ni |
|---|---|---|---|---|---|---|---|---|---|---|---|---|---|---|---|
| | | | | | | | | | | | | | | (weight %) | |
| Example | No.53 | 7.8 | 4.9 | 1.9 | 8.7 | 5.3 | 0.5 | 6.0 | 2.4 | 0.01 | 0.1 | 0.01 | — | — | Bal. |
| | No.54 | 7.8 | 4.9 | 1.9 | 8.7 | 5.3 | 0.5 | 6.0 | 2.4 | 0.01 | 0.1 | — | 0.01 | — | Bal. |
| | No.55 | 7.8 | 4.9 | 1.9 | 8.7 | 5.3 | 0.5 | 6.0 | 2.4 | 0.01 | 0.1 | — | — | 0.01 | Bal. |
| Comparative | No.56 | 7.8 | 4.9 | 1.9 | 8.7 | 5.3 | 0.5 | 6.0 | 2.4 | 0.01 | 0.1 | — | — | — | Bal. |
| Example | No.57 | 7.8 | 4.9 | 1.9 | 8.7 | 5.3 | 0.5 | 6.0 | 2.4 | 0.01 | 0.1 | 0.5 | — | — | Bal. |
| | No.58 | 7.8 | 4.9 | 1.9 | 8.7 | 5.3 | 0.5 | 6.0 | 2.4 | 0.01 | 0.1 | — | 0.5 | — | Bal. |
| | No.59 | 7.8 | 4.9 | 1.9 | 8.7 | 5.3 | 0.5 | 6.0 | 2.4 | 0.01 | 0.1 | — | — | 0.5 | Bal. |

TABLE 10 shows alloy compositions of the Examples of the present invention and the Comparative Examples. the Sample No. 53 of the Example is an alloy including yttrium of less than 1%, the Sample No.54 of the Example is an alloy including lanthanum of less than 1%, and the Sample No. 55 of the Example is an alloy including cerium of less than 1%. On the other hand, The Sample No. 56 of the Comparative Example is an alloy not including any one of yttrium, lanthanum and cerium, and the Sample Nos. 57–59 of the Comparative Examples are alloys including excessive amounts of yttrium, lanthanum and cerium.

Round bar-shaped single-crystal alloy samples (test pieces) were prepared with the use of the thus prepared melting stock through a withdrawal method. Subsequently, each of these samples was etched with the use of a mixed solution consisting of hydrochloric acid and aqueous hydrogen peroxide. It was confirmed, through a visual inspection, that the sample was entirely single-crystallized and that the direction of growth in crystal had an angle within (up to) 10 degrees with respect to the drawing direction. Then, the heat treatment was performed in accordance with the sequence of FIG. 1.

As for the high temperature oxidation tests, the samples were put into a furnace, heated for 8 hours at a temperature of 950° C. and then cooled to a room temperature. This cycle was repeated for 30 times, and thereafter, the variation in total mass amount due to the oxidation in addition of the mass of the samples and spalling scale per unit area in 30 cycles was measured.

TABLE 11

| Sample | Oxide Mass Variation (mg/cm$^2$) |
|---|---|
| No. 53 | 0.898 |
| No. 54 | 0.788 |
| No. 55 | 0.761 |
| No. 56 | 1.117 |
| No. 57 | 1.598 |
| No. 58 | 1.658 |
| No. 59 | 1.766 |

TABLE 11 shows the high temperature oxidation test results of alloys of Examples of the present invention, Comparative Examples and Conventional Example. From the TABLE 11, it was found that the increasing oxide mass amount of the Sample Nos. 53, 54 and 55 of the Example of the present invention in which yttrium, lanthanum or cerium was added in an amount within the present invention was 0.761 to 0.898 mg/cm$^2$, being relatively small amount, and exhibited good oxidation-resistant property in comparison with the Sample No. 56 of the Comparative Example in which yttrium, lanthanum and cerium were not added or the Sample Nos. 57, 58 and 59 of the Comparative Examples in which yttrium, lanthanum and cerium were excessively added.

Figure 6:
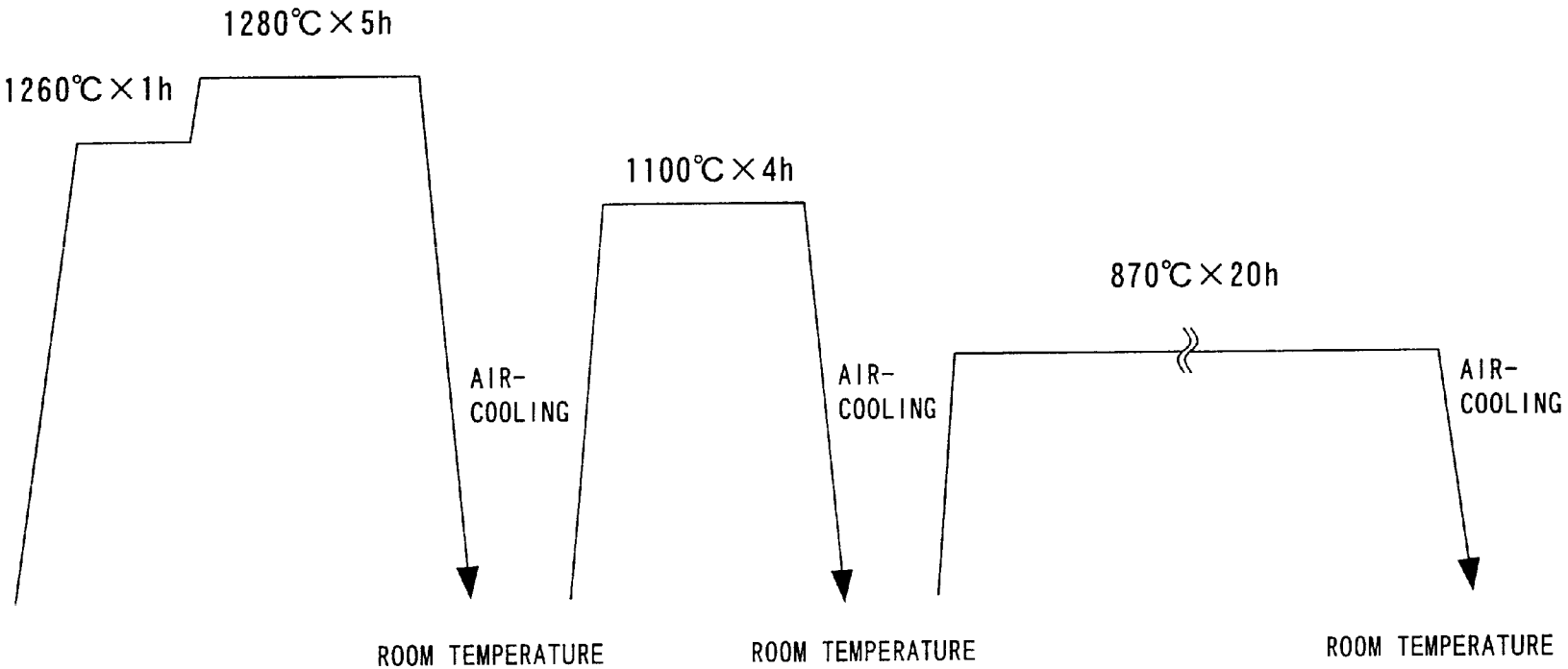
FIG. 6 is a diagram showing a heat treatment sequence with respect to examples of the invention and comparative examples in a fifth embodiment of the present invention.

Fifth Embodiment (FIG. 6, Tables 12 and 13)

This fifth embodiment represents a nickel-base single-crystal superalloy essentially consisting of any one of carbon, boron and zirconium in addition to cobalt, chromium, molybdenum, tungsten, aluminum, titanium, tantalum, rhenium, hafnium and silicon and the balance of nickel and inevitable impurity. As a material, there was used one prepared by adding one of carbon, boron and zirconium to the melting stock shown in TABLE 6.

TABLE 12

| | | Co | Cr | Mo | W | Al | Ti | Ta | Re | Si | Hf | C | B | Zr | Ni |
|---|---|---|---|---|---|---|---|---|---|---|---|---|---|---|---|
| | | | | | | | | | | | | | | (weight %) | |
| Example | No.60 | 7.8 | 4.9 | 1.9 | 8.7 | 5.3 | 0.5 | 6.0 | 2.4 | 0.01 | 0.1 | 0.05 | — | — | Bal. |
| | No.61 | 7.8 | 4.9 | 1.9 | 8.7 | 5.3 | 0.5 | 6.0 | 2.4 | 0.01 | 0.1 | — | 0.005 | — | Bal. |
| | No.62 | 7.8 | 4.9 | 1.9 | 8.7 | 5.3 | 0.5 | 6.0 | 2.4 | 0.01 | 0.1 | — | — | 0.03 | Bal. |
| Comparative Example | No.63 | 7.8 | 4.9 | 1.9 | 8.7 | 5.3 | 0.5 | 6.0 | 2.4 | 0.01 | 0.1 | — | — | — | Bal. |

The TABLE 12 shows alloy structures of the Examples of the present invention and the Comparative Examples. The Sample No. 60 of the Example is an alloy including carbon of a content of less than 0.1%, the Sample No. 61 is an alloy including boron of a content of less than 0.05% and the Sample No. 62 is an alloy including zirconium of a content of less than 0.1%. On the other hand, the Sample No. 63 of the Comparative Example is an alloy including no carbon, boron and zirconium.

Round bar-shaped single-crystal alloy samples (test pieces) were prepared for the Examples of the present invention and the Comparative Example through a withdrawal method. Subsequently, each of these samples was etched with the use of a mixed solution consisting of hydrochloric acid and aqueous hydrogen peroxide, and the heat treatment was performed in accordance with the sequence shown in FIG. 6 by selecting test material in which bigrain is formed to the test piece (sample). Thereafter, the test piece was worked so that the bigrain portion is arranged between gauges of the creep test pieces, and then, the creep rupture test was performed at a temperature of 1100° C. and under an atmosphere of a stress of 137 MPa so as to measure the rupture life, the extension and the contraction.

TABLE 13

| Sample | Creep Rupture Life (h) | Extension (%) | Contraction (%) |
|---|---|---|---|
| No. 60 | 148.6 | 20.6 | 30.7 |
| No. 61 | 125.8 | 26.2 | 20.6 |
| No. 62 | 178.0 | 25.4 | 20.6 |
| No. 63 | 70.8 | 20.6 | 20.3 |

TABLE 13 shows the test results, and as shown in this TABLE 13, the Sample Nos. 60, 61 and 62 of the Examples in which carbon, boron or zirconium was added exhibited high creep strength (resistance) and strengthened crystal grain boundary in comparison with the sample No. 63 of the Comparative Example.

From the results through the sample tests mentioned above, it was found that, according to the embodiments (Examples) of the present invention, the addition of carbon, boron or zirconium effectively contributes to twin formed as defect to the single-crystal superalloy and to improvement of grain boundary strength of the high angle grain boundary.

According to the nickel-base single-crystal superalloy described above of the present invention and the manufacturing method of such superalloy, it is possible to provide an excellent high-temperature strength and an excellent structural stability. Application of the above-mentioned nickel-base single-crystal superalloy to gas turbine blades and vanes makes it possible to provide gas turbine parts, which contribute to improvement in efficiency of the gas turbine.

What is claimed is:

1. A nickel-base single-crystal superalloy, consisting of, in percentages by weight, 4.0% to 11.0% of cobalt, 3.5% to less than 5.0% of chromium, 0.5% to 3.0% of molybdenum, 8.2% to 10.0% of tungsten, 4.5% to 6.0% of aluminum, 0.1% to 2.0% of titanium, 5.0% to 8.0% of tantalum, 1.0% to 3.0% of rhenium, 0.01% to 0.5% of hafnium, 0.01% to 0.1% of silicon, and at least one element selected from the group consisting of less than 2% of niobium, less than 1% of vanadium, less then 2% of ruthenium, less than 0.1% of carbon, less than 0.1% of lanthanum, and less than 0.1% of cerium, and a balance being nickel and inevitable impurity, a total amount of rhenium and chromium being not less than 4.0% and a total amount of rhenium, molybdenum, tungsten and chromium being not more than 18.0%.

2. A nickel-base single-crystal superalloy according to claim 1, wherein, in percentages by weight, cobalt is 5.0% to 10.0%, chromium is 4.0% to less than 5.0%, molybdenum is 1.0% to 2.5%, tungsten is 8.2% to 9.0%, aluminum is 5.0% to 5.5%, titanium is 0.1% to 1.0%, tantalum is 6.0% to less than 8.0%, rhenium is 2.0% to 3.0%, hafnium is 0.01% to 0.5%, and silicon is 0.01% to 0.1%.

3. A nickel-base single-crystal superalloy according to claim 1, wherein, in percentages by weight, cobalt is 5.0% to 10.0%, chromium is 4.0% to less than 5.0%, molybdenum is 1.0% to 2.5%, tungsten is 8.2% to 9.0%, aluminum is 5.0% to 5.5%, titanium is 0.8% to 1.5%, tantalum is 5.0% to less than 6.0%, rhenium is 2.0% to 3.0%, hafnium is 0.01% to 0.5%, and silicon is 0.01% to 0.1%.

4. A high temperature gas turbine part comprising the nickel-base single-crystal superalloy claimed in claim 1.

5. The nickel-base superalloy of claim 1, wherein niobium is present therein.

6. The nickel-base superalloy of claim 1, wherein vanadium is present therein.

7. The nickel-base superalloy of claim 1, wherein ruthenium is present therein.

8. The nickel-base superalloy of claim 1, wherein carbon is present therein.

9. The nickel-base superalloy of claim 1, wherein lanthanum is present therein.

10. The nickel-base superalloy of claim 1, wherein cerium is present therein.

11. A nickel-base single-crystal superalloy, consisting of, in percentages by weight, cobalt 5.0% to 10.0%, chromium 4.0% to less than 5.0%, molybdenum 1.0% to 2.5%, tungsten 8.2% to 9.0%, aluminum 5.0% to 5.5%, titanium 0.1% to 1.0%, tantalum 6.0% to 7.0%, rhenium 2.0% to 3.0%, hafnium 0.01% to 0.2%, silicon 0.01% to 0.1%, and at least one element selected from the group consisting of niobium of less than 2%, vanadium of less than 1%, ruthenium of less than 2%, carbon of less than 0.1%, boron of less than 0.05%, zirconium of less than 0.1%, yttrium of less than 0.1%, lanthanum of less than 0.1% and cerium of less than 0.1%.

12. A high temperature gas turbine part comprising the nickel-base single-crystal superalloy claimed in claim 11.

13. The nickel-base superalloy of claim 11, wherein niobium is present therein.

14. The nickel-base superalloy of claim 11, wherein vanadium is present therein.

15. The nickel-base superalloy of claim 11, wherein ruthenium is present therein.

16. The nickel-base superalloy of claim 11, wherein carbon is present therein.

17. The nickel-base superalloy of claim 11, wherein boron is present therein.

18. The nickel-base superalloy of claim 11, wherein zirconium is present therein.

19. The nickel-base superalloy of claim 11, wherein yttrium is present therein.

20. The nickel-base superalloy of claim 11, wherein lanthanum is present therein.

21. The nickel-base superalloy of claim 11, wherein cerium is present therein.

* * * * *